US005361655A

United States Patent [19]

Fowlkes

[11] Patent Number: 5,361,655

[45] Date of Patent: Nov. 8, 1994

[54] EXTENSIBLE TORQUE ROD

[76] Inventor: Alex S. Fowlkes, 4637 W. Bushnell Rd., Milton, Fla. 32583

[21] Appl. No.: 112,963

[22] Filed: Aug. 30, 1993

[51] Int. Cl.[5] ..... B25G 1/04

[52] U.S. Cl. ..... 81/177.2; 403/107

[58] Field of Search ..... 81/177.2; 16/115; 403/104–109, 325, 327, 330

[56] References Cited

U.S. PATENT DOCUMENTS

| | | | |
|---|---|---|---|
| 406,666 | 7/1889 | Pratt et al. | 81/177.2 X |
| 1,753,441 | 4/1930 | Morehouse | 81/177.2 X |
| 1,831,613 | 11/1931 | Symons | 403/105 X |
| 3,306,639 | 2/1967 | Lyon | 287/58 |
| 3,710,645 | 1/1973 | Bennett | 403/107 X |
| 4,317,393 | 3/1982 | Graffam | 81/177 |
| 4,960,015 | 10/1990 | Mathews | 81/117.2 |
| 5,033,337 | 7/1991 | Thomas, III | 81/177.2 |

*Primary Examiner*—D. S. Meislin

*Attorney, Agent, or Firm*—Russell Brewer

[57] ABSTRACT

An extendable/retractable torque bar with four functioning parts is given. The torque bar consists of an elongated hollow sleeve member, an elongated torque rod member with a series of notches on one longitudinal surface, a pivoting locking member held in a cavity of the hollow sleeve member with one end engaging a notch of the torque rod member and a spring for exerting a bias to the pivoting locking member keeping it engaged with a notch of the torque rod at all times.

The torque bar will automatically extend as separational forces are applied on its elongated members producing an automatic locking arrangement as each next notch in the series is encountered and producing an audible signal as each next notch is encountered. A further adaptation to the pivoting locking member and the rear most notch prevents accidental separation of the torque rod member from the hollow sleeve.

5 Claims, 2 Drawing Sheets

EXTENSIBLE TORQUE ROD

BACKGROUND OF THE INVENTION

1. Field of the Invention

This invention relates to the field of adjustable and extendable torque bars of the type used for connecting driving tools to driven tools such as ratchet wrenches and sockets.

2. Prior Art

A torque bar or extension is a tool used to vary the distance between a driving tool, e.g., a ratchet or torque wrench and a driven tool, e.g., a socket. The first such extensions were of a fixed length necessitating the user to collect several of varied distances to accommodate a variety of situations. It became apparent that a need existed for a single extension that could be adjusted in length to provide a variety of lengths between a driving tool and a driven tool while still withstanding nominal torque forces. Many adjustable extensions have been proposed to accomplish this task. Most appear to be based upon the concept of a multi-sided tubular sleeve and a multi-sided rod telescopically positioned within the tubular sleeve. Variations in length were provided by threaded means, notches, etc. on the rod which mated with a locking mechanism carried by the tubular sleeve for positioning the telescoping rod at a fixed location vis-a-vis the tubular sleeve.

Several U.S. patents have been issued which illustrate adjustable extension bars. These include:

U.S. Pat. No. 3,306,639 discloses an extensible torque rod having a hexagonal rod telescopically engaged within a hexagonal shaped tube. A front end of the hexagonal rod is adapted for communication with a socket and the rear end of the hexagonal rod engages the front end of the hexagonal tube. The rear end of the tube is adapted for communication with a wrench. One side of the rod has a plurality of transverse and rounded grooves designed for engagement with a spring-pressed roller. In order to elongate or shorten the extension a collar is slid longitudinally with respect to the tube to release the spring-pressed roller and thereby disengage the roller from the groove thus "unlocking" the rod.

U.S. Pat. No. 4,960,015 discloses an adjustable torque rod comprising a rod telescopically mounted within a tubular shaped member. The rod carries a plurality of V shaped notches or teeth. Extension of the rod within the tubular member is controlled by a pawl supported by the tubular member which engages the V shaped notches. Like '639, this extensible bar utilizes a longitudinal slidable sleeve to release the pawl from engagement with the V shaped notches and thereby permit extension or contraction of the rod.

U.S. Pat. No. 4,317,393 discloses an extensible torque bar which utilizes an elongated rod having internal threads which engage with external threads associated with a sleeve. To elongate or retract the rod vis-a-vis the sleeve, the sleeve is rotated.

U.S. Pat. No. 5,033,337 discloses an extensible torque bar having circular indentations along a rod telescopically mounted within a tubular sleeve. A ball element is biased toward the circular indentations for maintaining the rod at a fixed location. A slidable pin is used to release the ball element. In another embodiment, the circular indentations extend around the periphery of an intermediate and extensible tube. The intermediate tube carries the rod thereby providing for multiple extensions within a single, adjustable torque rod.

Some problems noted with adjustable extension bars of the prior art are as follows:

1) most require one to unlock the extension in order to effect elongation and most are difficult to contract or extend;

2) substantial time is required to make adjustments from minimum to maximum lengths, and in addition, positioning and locking at new adjustments are assured only by sight or feel; and, 3) many do not have a provision for stopping the complete and undesirable disengagement of the telescopic rod from the elongated tube or sleeve;

SUMMARY OF THE INVENTION

This invention relates to an improved adjustable extension or torque bar comprising: (a) an elongated sleeve having a multi-sided cross-sectional bore therein, said elongated sleeve having a rear end adapted for communication with a driving tool and a front end for receipt of a multi-sided rod, (b) a multi-sided rod having a cross-sectional area complimentary with the multi-sided bore of said sleeve for slidable and non rotatable engagement within said sleeve, said multi-sided rod having a rear end for communication with the front end of said elongated sleeve and a front end adapted for communication with a driven tool, said rod having a plurality of indentations capable of engaging with a pawl having an abutment complimentary configured to conform to the indentations on said multi-sided rod and carried by the elongated sleeve and (c) actuating means for engaging and disengaging the abutment communicating with the indentations thereby permitting one to extend and contract the multi-sided rod within said sleeve. The improvement for facilitating the adjustment of the rod vis-a-vis the elongated sleeve comprises:

a multi-sided rod having a plurality of notches along at least one side of said multi-sided rod wherein the rear edge of the notches have an acute angular slope and an angular frontal edge having a slope greater than the acute angular slope of the rear edge of said notch but the angle of frontal edge not substantially greater than ninety degrees to the longitudinal axis of the multi-sided rod and;

a pawl having at least one tooth having a frontal edge of a slope complimentary with the angular slope of said frontal edge of said notch, and a sloping rear edge complimentary with the acute angular slope of the rear edge of said notch for slidable movement over the surface of the rear portion of said notch; and, means for engaging and disengaging the pawl from the notches on said multi-sided rod. In a preferred embodiment at least one notch at a rearward section of said multi-sided rod will have at least a downward and rearward projection (top to bottom of notch) on the rear of the notch and an indentation at an upper end of said tooth for engagement with the downward and rearward projection on the rear portion of the notch at said rearward section of said multi-sided rod.

Several advantages are associated with the extensible torque rod described herein and these include:

provisions to adjust to a new length by application of longitudinal separational forces and means to prevent longitudinal compressional forces are maintained are applied;

adjustments may be made to the length of the torque rod while the torque rod is in place thereby enhancing user friendliness;

provisions for preventing accidental separation of the telescopic multi-sided rod from the elongated sleeve but yet the telescoping rod may be easily exchanged for another.

provisions for an audible click at each successive stage of extended length thereby providing the user some guide as to the extension length.

DETAILED DESCRIPTION OF THE INVENTION

Figure 1:
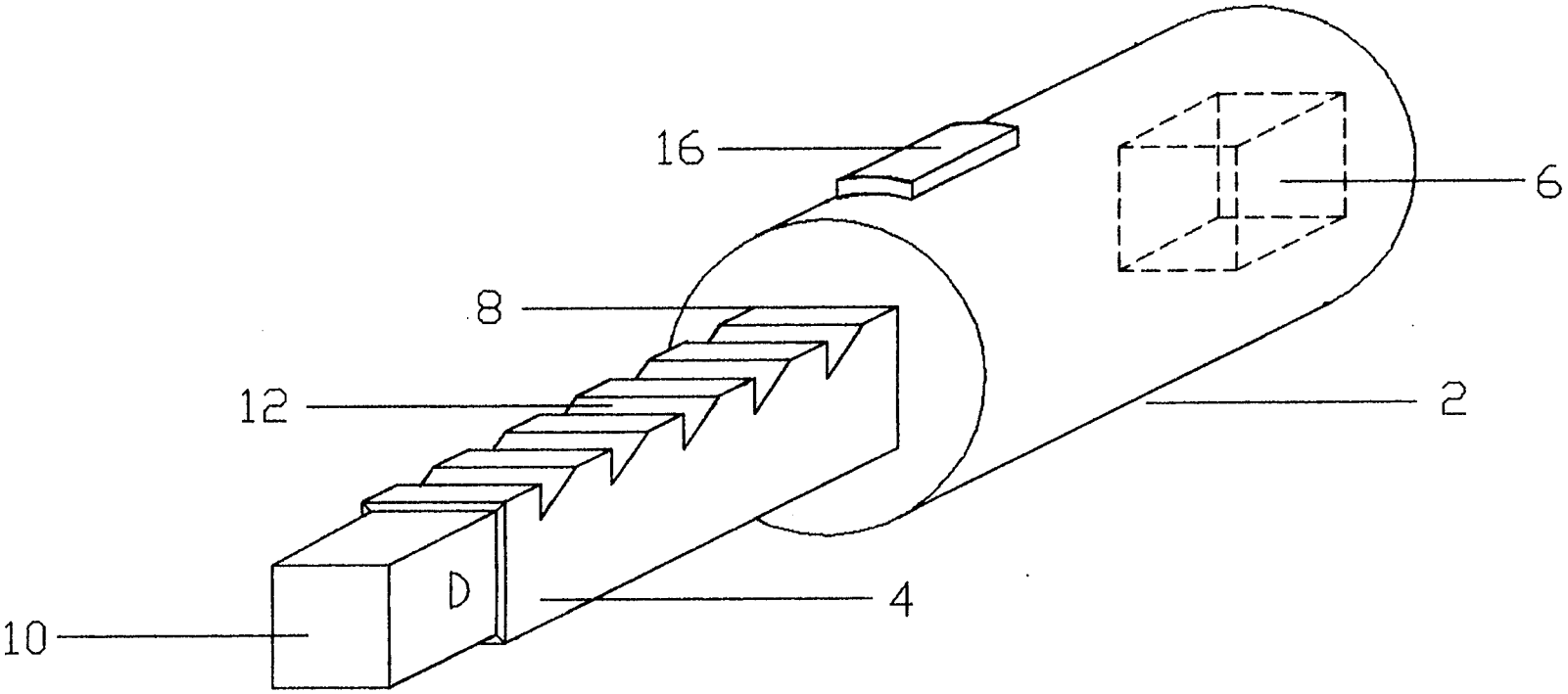
FIG. 1 is an isometric view of a partially extended, torque bar.

Referring to the drawings, FIG. 1 is an isometric view of the extensible torque rod in its partially extended form. As with conventional torque extension bars, there is an elongated sleeve 2 having a multi-sided bore therein for receipt of a multi-sided rod 4 having a cross-section complimentary with the multi-sided bore. Typically, the cross-section of the bore and rod is hexagonal or rectangular. Sleeve 2 has a rear end 6 adapted for receipt or communication with a driving tool such as a wrench. Sleeve 2 has a frontal end 8 adapted for non rotatable receipt of multi-sided rod 4.

Figure 2:
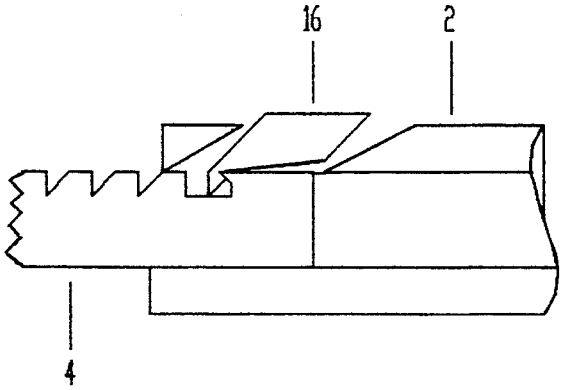
FIG. 2 is a partial cross sectional view of a fully extended bar showing the pawl tooth engaged with the rear notch.
Figure 3:
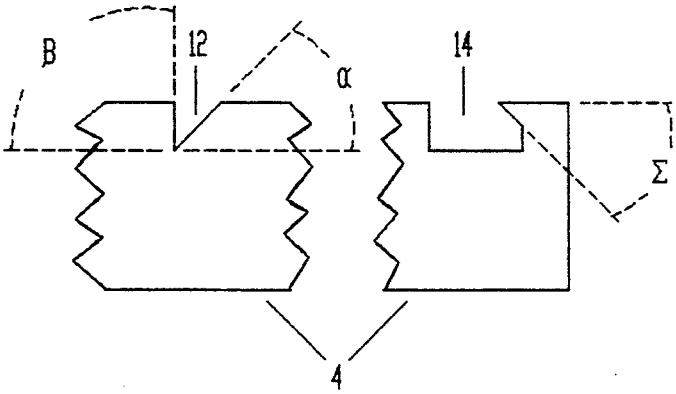
FIG. 3 is a cross sectional view of a notch from a front part of the multi-sided rod and a notch from a rear portion of the multi-sided rod.

Referring to FIGS. 1, 2, and 3 multi-sided rod 4 is adapted for slidable movement within the bore of sleeve 2. The rear portion of rod 4 is placed within the front portion of said multi-sided bore of the sleeve. With this generally conventional structure, a rotational force applied by a wrench to the elongated sleeve, transfers the rotation to the multi-sided rod and thus to the socket. Rod 4 has a frontal end 10 adapted for communication with a driven tool, e.g., a socket. Along at least one side of multi-sided rod 4 there are a series of geometric shaped notches 12 having a frontal portion or edge generally perpendicular to the longitudinal axis of rod 4. The rear portion or edge of notches 12 has a generally forward slope (top to bottom) forming an acute angle $\alpha$ to the longitudinal axis of rod 4. Typically angle $\alpha$ is from about 30° to 60° from the longitudinal axis. The frontal edge of notches 12 have an angular portion $\beta$. The angle $\beta$ generally is perpendicular to the longitudinal axis of the multi-sided rod and must exceed angle $\alpha$ of the rear portion of notches 12. Typically angle $\beta$ may extend from about 45° to 100°. A specially designed notch 14 is located at a rear portion of rod 4. The tip, generally with a more upright to rearward slope (top to bottom), having an angle $\Sigma$ provides a means for preventing the accidental removal of rod 4 from elongated sleeve 2. This angle is generally at least 90° and generally 90° to 150° or greater.

Figure 4:
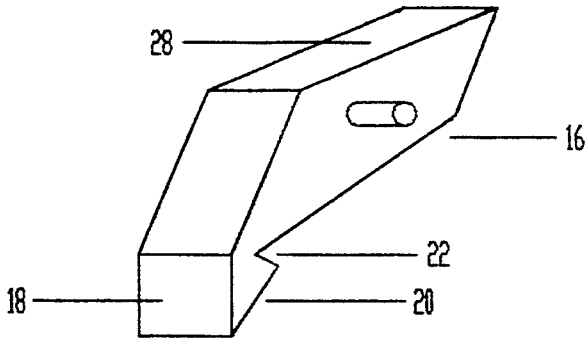
FIG. 4 is a perspective view of the pawl.

Referring to FIG. 4, a pawl 16 is carried by sleeve 2 for engagement with notches 12. The pawl 16 is designed for pivotal movement relative to the longitudinal axis of sleeve 2 and rod 4. The pawl has a frontal edge 18 of a slope or angle complimentary to angle $\beta$. With the surfaces being complimentary, the pawl when engaged with a notch on rod 4 prevents contraction of rod 4 in sleeve 2 on application of a compressive force. The pawl must be released from the notch in order to permit contraction of rod 4. On the other hand, the rear slope 20 of pawl 16 has a slope complimentary to angle $\alpha$. By appropriate selection of angle $\alpha$ to the longitudinal axis of rod 4, the pawl is able to slide over the rear surface of notch 12, thereby permitting extension without release of pawl 16. Pawl 16 also has a upright to forward sloping surface 22 in addition to the forward sloping surface 20. This surface is complimentary to angle $\Sigma$ present on the tip of rear notch 14 on rod 4. The surfaces 20 and 22 permit the pawl to slide during extension over all of the notches 12 on rod 4 except last notch 14 without engagement. On contact with the last notch, surface 22 engages the tip at angle $\Sigma$ and prevents further extension.

The pawl is pivotally mounted on sleeve 2 so that it can be engaged and disengaged from the notches 12. To maintain the pawl in contact with notches 12, a spring or means (not shown) is used to force the pawl downwardly for contact with the notches 12. A button like or thumb activated pivoting lock member 28 is in communication with pawl 16 which, when pressed, acts to force pawl to pivot upwardly and away from notches 12, including the last notch 14 on rod 4. On disengagement, rod 4 may be contracted or completed released from sleeve 2.

What is claimed is:

1. In an adjustable extension or torque bar comprising: (a) an elongated sleeve having a multi-sided cross-sectional bore therein, said elongated sleeve having a rear end adapted for communication with a driving tool and a front end for receipt of a multi-sided rod, (b) a multi-sided rod having a cross-sectional area complimentary with the multi-sided bore of said sleeve for slidable and non rotatable engagement within said sleeve, said multi-sided rod having a rear end for communication with the front end of said elongated sleeve and a front end adapted for communication with a driven tool, said multi-sided rod having a plurality of notches, (c) a pawl having at least one tooth configured to conform to the notches on said multi-sided rod and (d) means for engaging and disengaging a tooth of said pawl with a notch on said multi-sided rod thereby permitting one to extend and contract the multi-sided rod within said sleeve, the improvement for facilitating the adjustment of the rod vis-a-vis the elongated sleeve without inadvertent separation of said rod from said sleeve which comprises:

said plurality of notches having a frontal edge and a rear edge along at least one side of said multi-sided rod wherein the rear edge of the notches has an acute angular slope $\alpha$ to the longitudinal axis of the multi-sided rod and the frontal edge has a slope greater than the acute angular slope of the rear edge of said notches but the angle of said frontal edge being not substantially greater than ninety degrees to the longitudinal axis of the multi-sided rod and further wherein said multi-sided rod has at least one notch at a rear section which has a downward and rearward projection on the said at least one notch rear of the notch and said pawl having an indentation at an upper and rear end of said tooth having a forward slope for engagement with the downward and rearward projection of the notch at said rearward section of said multi-sided rod.

2. The extension of claim 1 wherein said at least one notch having an angular slope Σ of from 90° to 150°.

3. The adjustable extension of claim 2 wherein the means for engaging and disengaging a tooth of said pawl with a notch comprises a button pivotedly disposed for inward and outward movement communicating with the pawl.

4. The adjustable extension of claim 1 wherein the angle $\alpha$ is from about 30° to 60°.

5. The adjustable wrench of claim 3 wherein a spring is used for forcing the pawl against the notches.

* * * * *